US011799238B2

(12) United States Patent
Yamada

(10) Patent No.: US 11,799,238 B2
(45) Date of Patent: Oct. 24, 2023

(54) CONNECTOR

(71) Applicant: SUMITOMO WIRING SYSTEMS, LTD., Mie (JP)

(72) Inventor: Shuhei Yamada, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 66 days.

(21) Appl. No.: 17/527,286

(22) Filed: Nov. 16, 2021

(65) Prior Publication Data

US 2022/0166163 A1 May 26, 2022

(30) Foreign Application Priority Data

Nov. 24, 2020 (JP) ..... 2020-194625

(51) Int. Cl.
*H01R 13/627* (2006.01)
*H01R 13/629* (2006.01)

(52) U.S. Cl.
CPC ... *H01R 13/6272* (2013.01); *H01R 13/62927* (2013.01)

(58) Field of Classification Search
CPC ..... H01R 13/4538; H01R 13/6272; H01R 13/62927
USPC ..... 439/140
See application file for complete search history.

(56) References Cited

U.S. PATENT DOCUMENTS 7,267,562 B2 * 9/2007 Katsuma ..... H01R 13/516 439/140
8,038,455 B1 * 10/2011 Moraes ..... H01R 13/4538 439/140
9,509,093 B2 * 11/2016 Shimizu ..... H01R 13/62938
10,276,966 B1 * 4/2019 Hitchcock ..... H01R 13/506
10,498,066 B1 * 12/2019 Sundarakrishnamachari ..... H01R 13/4538
2003/0119349 A1 * 6/2003 Bakker ..... H01R 13/4538 439/140
2007/0155254 A1 * 7/2007 Daudin ..... H01R 13/4361 439/752
2008/0102667 A1 * 5/2008 Ikeya ..... H01R 13/4538 439/157
2009/0311896 A1 * 12/2009 Myer ..... H01R 13/4223 439/248
2010/0105254 A1 * 4/2010 Park ..... H01R 13/4538 439/752

(Continued)

FOREIGN PATENT DOCUMENTS

JP 2007-317442 A 12/2007
JP 2016-051666 A 4/2016
WO 2014/192800 A1 12/2014

*Primary Examiner* — Gary F Paumen

(74) *Attorney, Agent, or Firm* — Venjuris, P.C.

(57) ABSTRACT

A receptacle 47 includes a resiliently deformable lock arm 55 extending in a front-rear direction. The lock arm 55 includes a locking projection 57 projecting into the receptacle 47 from a rear end part and a stopping projection 59 projecting into the receptacle 47 from a location forward of the locking projection 57. The moving plate 42 includes a lock portion 76 at a position corresponding to the lock arm 55. A rear surface of the lock portion 76 faces the locking projection 57 to restrict a movement of the moving plate 42 to a connection position and a front surface of the lock portion 76 faces the stopping projection 59 to restrict a forward movement of the moving plate 42 when the moving plate 42 is at the initial position.

3 Claims, 10 Drawing Sheets

(56) References Cited

U.S. PATENT DOCUMENTS

| | | | | |
|---|---|---|---|---|
| 2010/0227495 | A1* | 9/2010 | Matsumura | H01R 13/631<br>264/299 |
| 2015/0004830 | A1* | 1/2015 | Gomez | H01R 13/4538<br>439/374 |
| 2017/0214174 | A1* | 7/2017 | Suzuki | H01R 13/5213 |
| 2017/0214179 | A1* | 7/2017 | Suzuki | H01R 13/4538 |
| 2019/0372269 | A1* | 12/2019 | Hirota | H01R 13/631 |
| 2019/0379159 | A1* | 12/2019 | Yasuda | H01R 13/71 |
| 2020/0153154 | A1* | 5/2020 | Mamiya | H01R 13/5202 |
| 2020/0169027 | A1* | 5/2020 | Yasuda | H01R 13/631 |
| 2020/0303877 | A1* | 9/2020 | Kawamoto | H01R 13/4538 |

* cited by examiner

CONNECTOR

CROSS-REFERENCE TO RELATED APPLICATIONS

This application is based on and claims priority from Japanese Patent Application No. 2020-194625, filed on Nov. 24, 2020, with the Japan Patent Office, the disclosure of which is incorporated herein in their entireties by reference.

TECHNICAL FIELD

The present disclosure relates to a connector.

BACKGROUND

A connector described in Japanese Patent Laid-open Publication No. 2007-317442 includes a female housing and a male housing connectable to and separable from each other, a moving plate arranged in a receptacle of the male housing movably between an initial position and a connection position and male tabs arranged to project into the receptacle. Front end parts of the male tabs are covered and protected by the moving plate at the initial position. Movement restricting portions are provided on the left and right surfaces of the receptacle, and stopper surfaces are provided on the upper and lower surfaces of the receptacle.

The moving plate is provided with retaining portions at positions corresponding to the movement restricting portions and auxiliary locking portions at positions corresponding to the stopper surfaces. When the moving plate is at the initial position, the auxiliary locking portions face the stopper surfaces, thereby restricting a movement of the moving plate from the initial position to the connection position. Further, the retaining portions face the movement restricting portions, thereby restricting a forward movement of the moving plate. Note that, although not described, a connector provided with a moving plate of this type or a member equivalent to the moving plate is also disclosed in International Publication No. WO2014/192800 and Japanese Patent Laid-open Publication Nos. 2016-046085 and 2016-051666.

SUMMARY

In the conventional connector, a restricting structure for restricting a movement of the moving plate from the initial position to the connection position and a restricting structure for restricting a forward movement of the moving plate at the initial position are provided at separate locations. However, in terms of simplifying the configuration of the moving plate, it is desired to realize the both restricting structures at the same location.

Accordingly, the present disclosure aims to provide a connector capable of simplifying the configuration of a moving plate.

The present disclosure is directed to a connector with a male housing including a receptacle open forward, a female housing to be fit into the receptacle, a moving plate to be arranged in the receptacle movably between an initial position and a connection position rearward of the initial position, and a male terminal arranged to project into the receptacle, a front end part of the male terminal being covered by the moving plate at the initial position, wherein the receptacle includes a resiliently deformable lock arm extending in a front-rear direction, the lock arm includes a locking projection projecting into the receptacle from a rear end part of the lock arm and a stopping projection projecting into the receptacle from a location forward of the locking projection, the moving plate includes a lock portion at a position corresponding to the lock arm, and a rear surface of the lock portion faces the locking projection to restrict a movement of the moving plate to the connection position and a front surface of the lock portion faces the stopping projection to restrict a forward movement of the moving plate when the moving plate is at the initial position.

According to the present disclosure, it is possible to provide a connector capable of simplifying the configuration of a moving plate.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
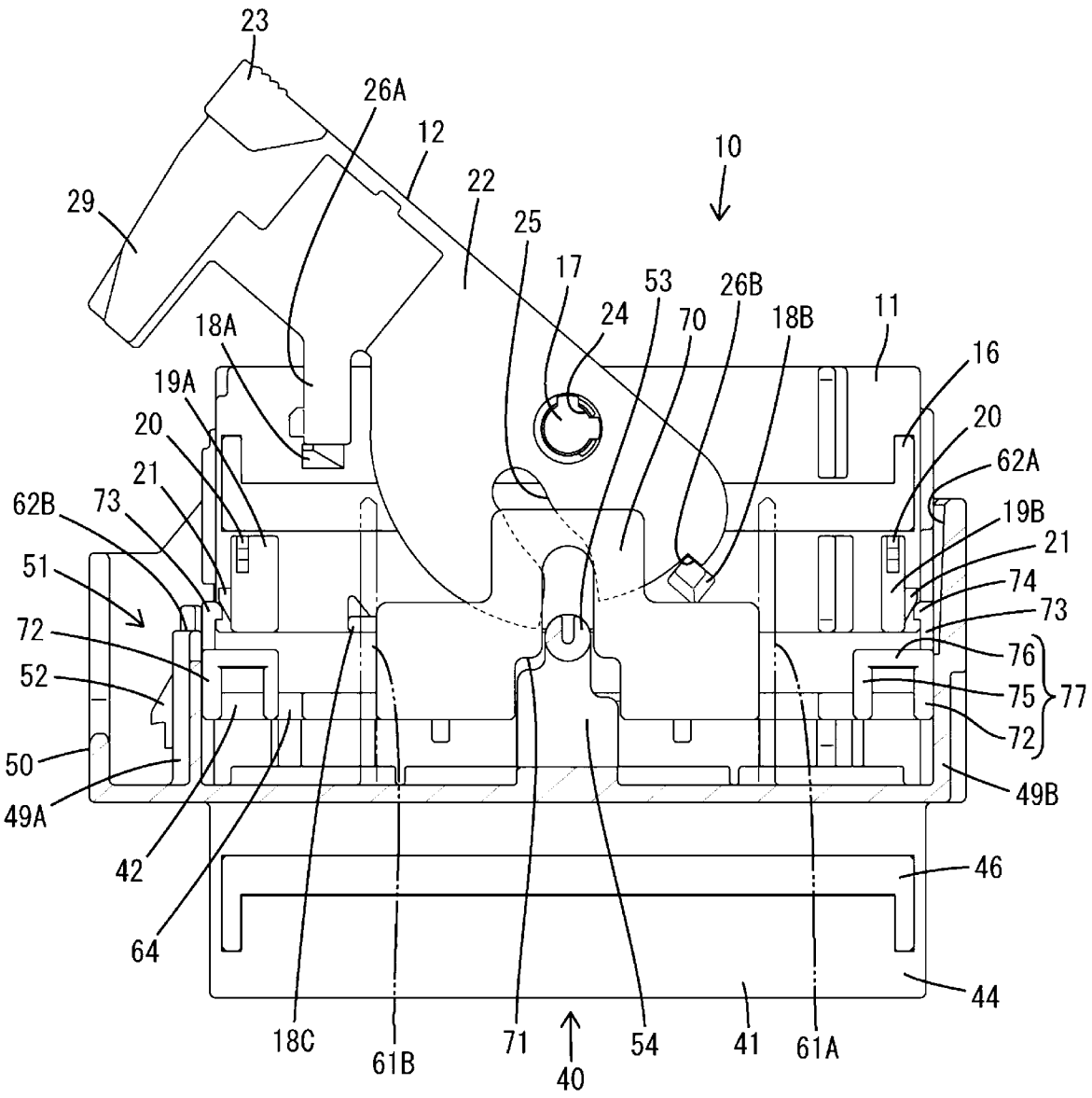
FIG. 1 is a plan view in section showing a state where a lever is at a lever initial position and a female housing and a male housing are lightly connected in a connector of an embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The connector of the present disclosure is provided with a male housing including a receptacle open forward, a female housing to be fit into the receptacle, a moving plate to be arranged in the receptacle movably between an initial position and a connection position rearward of the initial position, and a male terminal arranged to project into the receptacle, a front end part of the male terminal being covered by the moving plate at the initial position, wherein the receptacle includes a resiliently deformable lock arm extending in a front-rear direction, the lock arm includes a locking projection projecting into the receptacle from a rear end part of the lock arm and a stopping projection projecting into the receptacle from a location forward of the locking projection, the moving plate includes a lock portion at a position corresponding to the lock arm, and a rear surface of the lock portion faces the locking projection to restrict a movement of the moving plate to the connection position and a front surface of the lock portion faces the stopping projection to restrict a forward movement of the moving plate when the moving plate is at the initial position.

According to the above configuration, a restricting structure for restricting a movement of the moving plate from the initial position to the connection position and a restricting structure for restricting a forward movement of the moving plate at the initial position are collectively provided on the lock portion, and the configuration of the moving plate can be simplified.

(2) Preferably, the female housing includes a releasing portion at a position corresponding to the lock arm, the lock arm includes a released portion projecting into the receptacle from a location forward of the locking projection, a rear surface of the released portion is shaped to be inclined forward and contacts the releasing portion to displace the lock arm in a direction away from the lock portion when the moving plate moves from the connection position to the initial position.

According to the above configuration, when the female housing and the male housing are separated, the releasing portion contacts the rear surface of the released portion and the lock arm is displaced in the direction away from the lock portion in the process of moving the moving plate from the connection position to the initial position. Thus, interference resistance between the rear surface of the lock portion and the locking projection of the lock arm can be reduced or eliminated. Therefore, a guide slope for reducing interference resistance with the locking projection needs not be provided on the rear surface of the lock portion. As a result, the rear surface of the lock portion can be, for example, shaped to rise in a direction orthogonal to the front-rear direction and a state where the rear surface of the lock portion is stopped in contact with the stopping projection can be satisfactorily realized.

(3) The female housing may include a hooking portion and the moving plate may include a locking portion to be locked to the hooking portion to enable a movement from the connection position to the initial position, the moving plate may include a plate body having a rectangular outer edge shape formed by a pair of short side portions, a pair of long side portions and four corner portions, the locking portions or the lock portions may be arranged in a pair on the sides of the corner portions on each of the pair of long side portions and the others of the lock portions and the locking portions may be arranged in a pair on the sides of the corner portions on each of the pair of short side portions, and the hooking portions are arranged at positions corresponding to the respective locking portions and the lock arms are arranged at positions corresponding to the respective lock portions.

According to the above configuration, when the moving plate is at the initial position, the lock portions arranged in pairs on the sides of the four corner portions of the plate body can respectively face the locking projections. Thus, a movement of the moving plate to the connection position can be satisfactorily restricted. Further, when the moving plate moves from the connection position to the initial position, the locking portions arranged in pairs on the sides of the four corner portions of the plate body can be respectively locked to the hooking portions. Thus, the moving plate can be satisfactorily moved to the initial position. Further, since the locking portions and the lock portions are arranged across the four corner portions in the plate body, a degree of freedom in forming the locking portions and the lock portions can be enhanced.

(4) The moving plate may include guide walls projecting forward from intermediate parts of the pair of long side portion, and the receptacle may include guide ribs on inner surfaces facing the pair of long side portions, the guide ribs extending in the front-rear direction and contacting the guide walls.

According to the above configuration, in the process of moving the moving plate from the connection position to the initial position, the guide walls can contact the guide ribs and the inclination of the moving plate in the receptacle can be suppressed. Particularly, since either the locking portions or the lock portions are arranged on the sides of the four corner portions, formation regions of the guide walls can be satisfactorily secured in the intermediate parts of the long side portions.

Details of Embodiments of Present Disclosure

A specific example in an embodiment of the present disclosure is described below with reference to the drawings. Note that the present invention is not limited to this illustration and is intended to be represented by claims and include all changes in the scope of claims and in the meaning and scope of equivalents.

Figure 2:
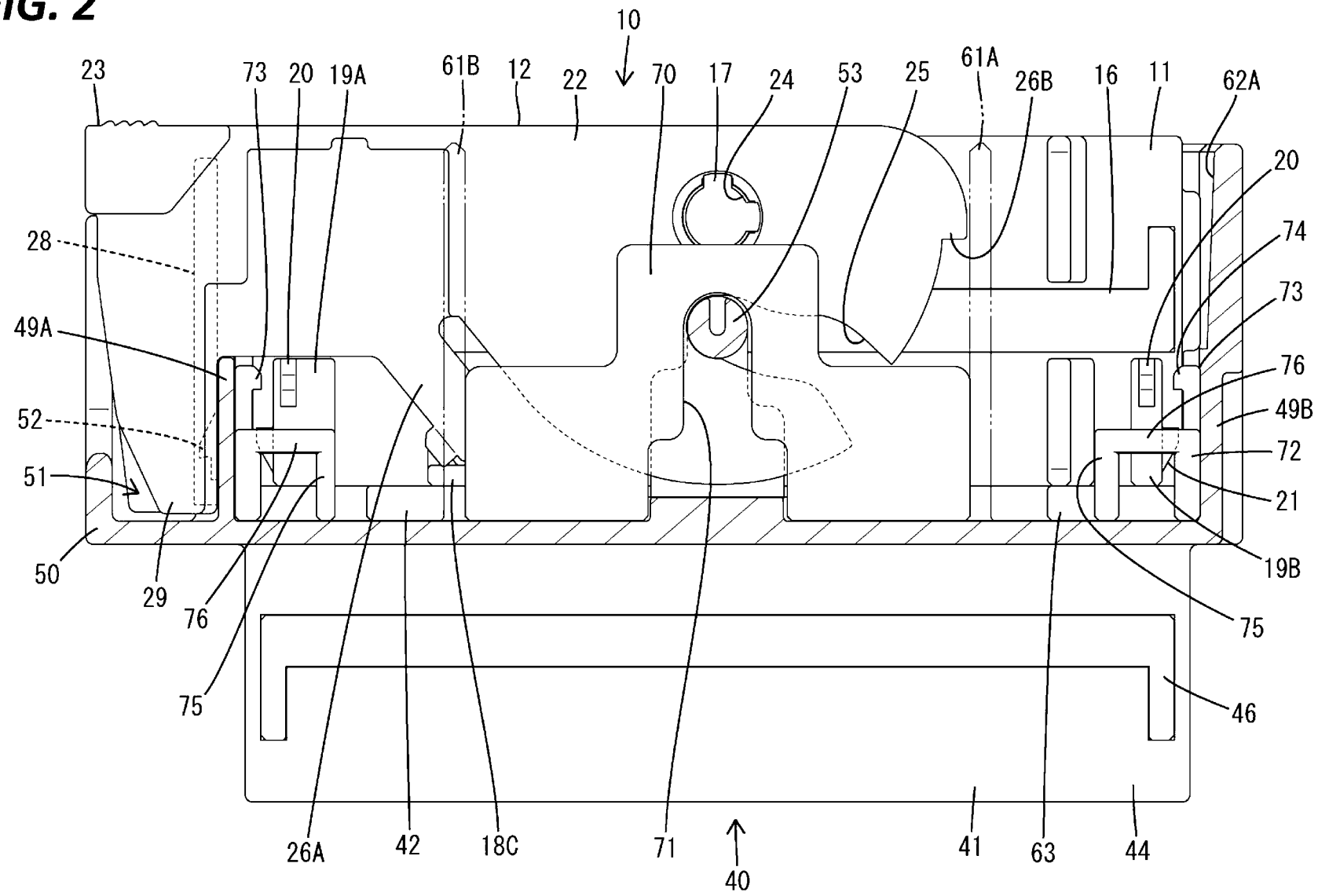
FIG. 2 is a plan view in section showing a state where the lever is at a lever connection position and the female housing and the male housing are properly connected.
Figure 3:
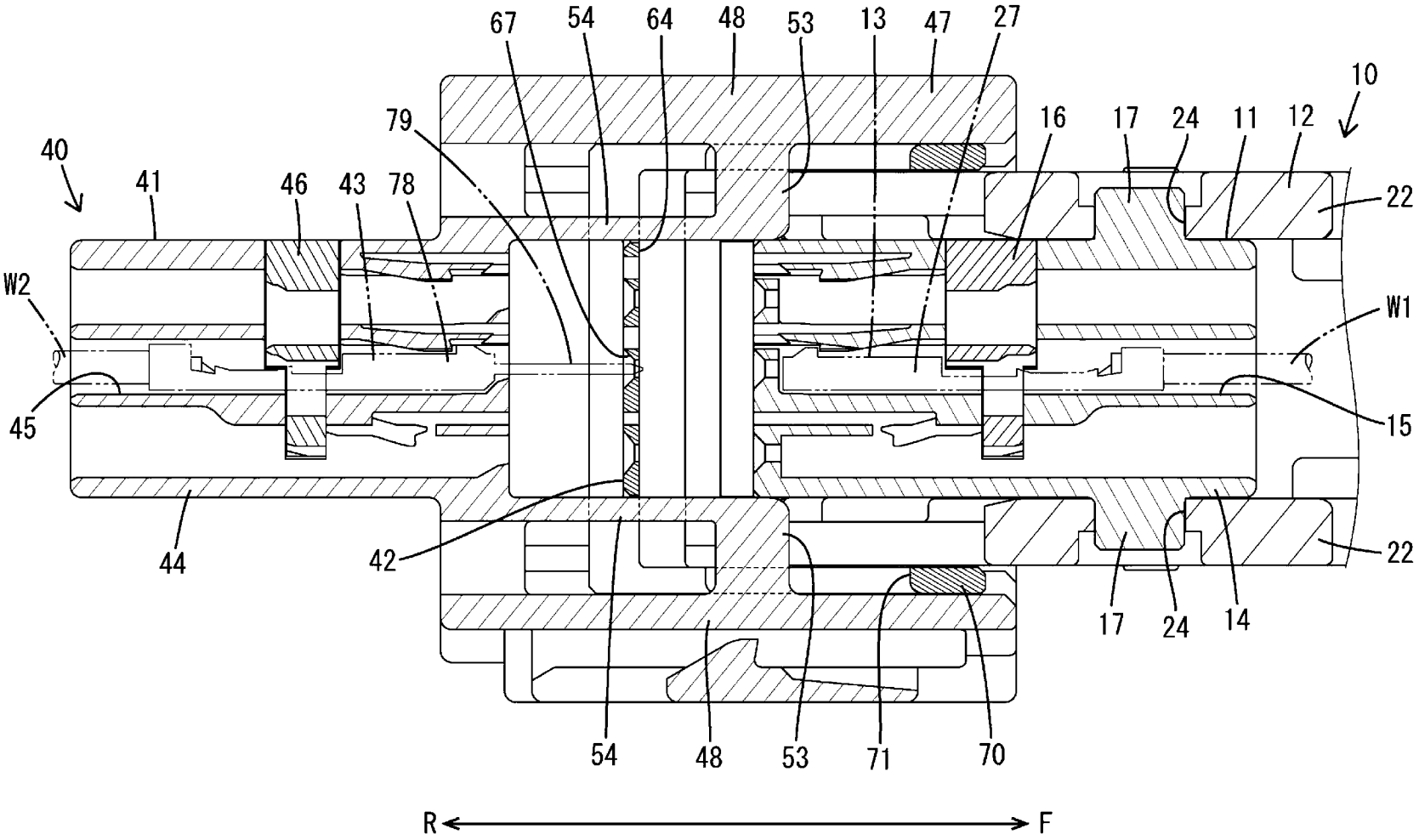
FIG. 3 is a side view in section showing a state where a moving plate is at an initial position and the female housing and the male housing are lightly connected.

A connector of the embodiment is composed of a female connector 10 and a male connector 40 as shown in FIGS. 1 to 3. As shown in FIG. 3, the female connector 10 includes a female housing 11, a lever 12 and female terminals 13. The male connector 40 includes a male housing 41, a moving plate 42 and male terminals 43. The female housing 11 and the male housing 41 are connectable to and separable from each other. Note that, in the following description, a right side of FIG. 3 is referred to as a front side (F side) and a left side of FIG. 3 is referred to as a rear side (R side). A vertical direction is based on a vertical direction of FIG. 3. A lateral direction is based on a lateral direction of FIGS. 1 and 2. The front-rear direction, vertical direction and lateral direction described above do not necessarily coincide with actual directions during use.

<Female Housing>

Figure 7:
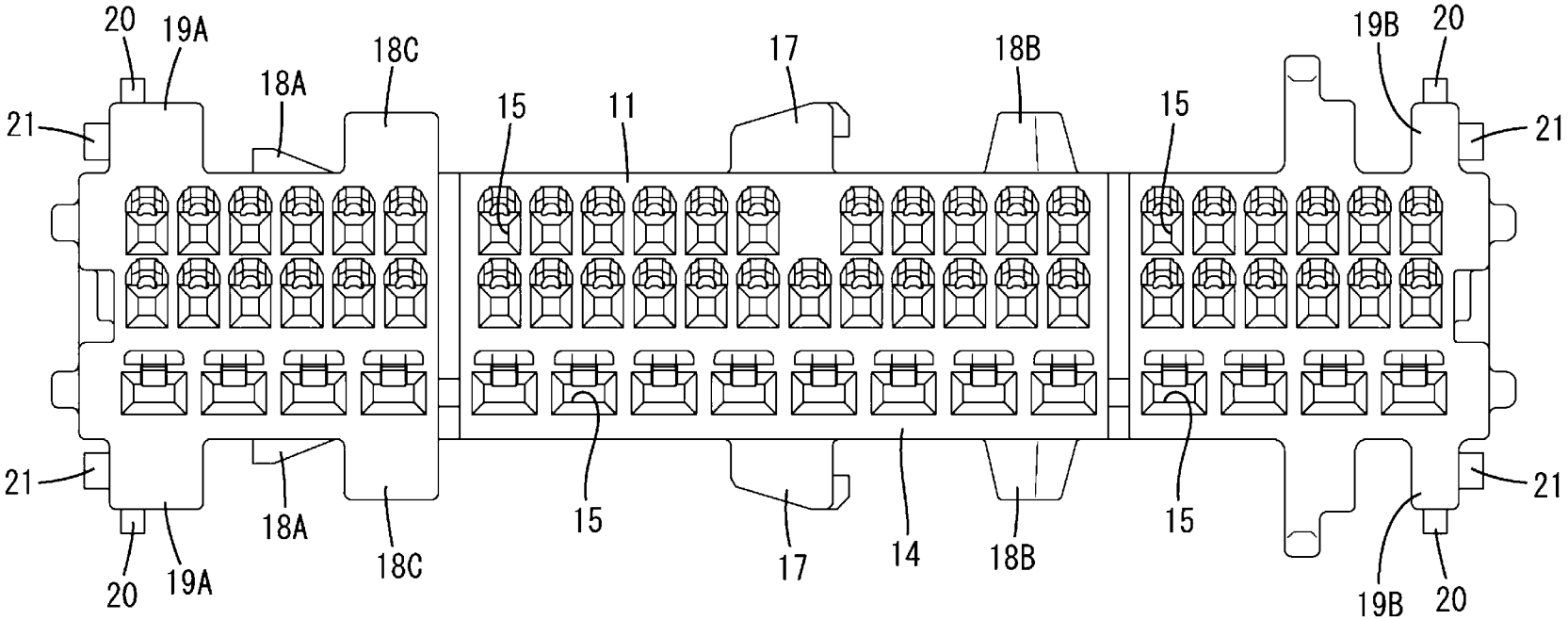
FIG. 7 is a front view of the female housing.

The female housing 11 is made of synthetic resin and includes, as shown in FIG. 7, a female housing body 14 long in the lateral direction as a whole. The female housing body 14 includes a plurality of female cavities 15 extending in the front-rear direction. As shown in FIG. 3, the female terminal 13 is inserted and accommodated into the female cavity 15 from front. A front retainer 16 for retaining the female terminals 13 is mounted into the female housing body 14.

As shown in FIG. 7, the female housing 11 includes a pair of support shafts 17 projecting from central parts of the upper and lower surfaces of the female housing body 14. As shown in FIGS. 1 to 3, the lever 12 is rotatably supported on the support shafts 17.

As shown in FIG. 7, the female housing 11 includes a plurality of housing-side engaging portions 18A, 18B and 18C projecting from the upper and lower surfaces of the female housing body 14. Out of these, the housing-side engaging portions 18A, 18B contact the lever 12 at a lever initial position (see FIG. 1), and the housing-side engaging portions 18C contact the lever 12 at a lever connection position (see FIG. 2).

As shown in FIG. 7, the female housing 11 includes a pair of base portions 19A, 19B projecting from both left and right end parts of each of the upper and lower surfaces of the female housing body 14. The base portions 19A, 19B are in the form of rectangular blocks. The base portions 19A arranged on a left side of FIG. 7 are formed to be wider than the base portions 19B arranged on a right side of FIG. 7.

A releasing portion 20 and a hooking portion 21 respectively project on two surfaces on both sides of one laterally outer corner of the base portion 19A, 19B. As shown in FIGS. 1, 2 and 7, the releasing portions 20 are provided to project on front end parts of the upper surfaces of the base portions 19A, 19B arranged on an upper side and front end parts of the lower surfaces of the base portions 19A, 19B arranged on a lower side. The hooking portions 21 are provided to project on rear end parts of the left side surfaces of the base portions 19A and rear end parts of the right side surfaces of the base portions 19B.

Figure 4:
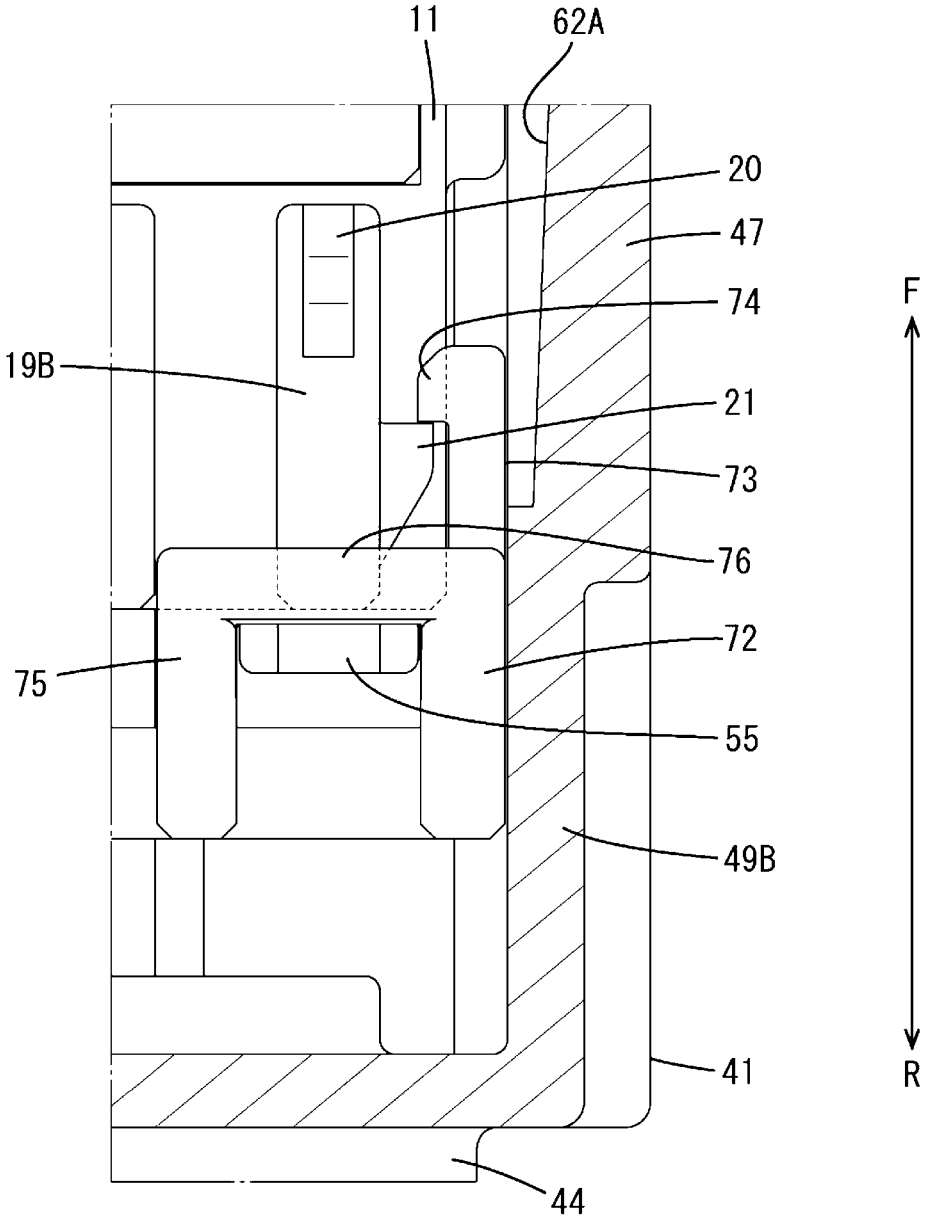
FIG. 4 is a partial enlarged section showing a state where a hooking portion of the female housing locks a locking portion of the moving plate and the moving plate moves toward the initial position in the process of separating the female housing and the male housing.
Figure 5:
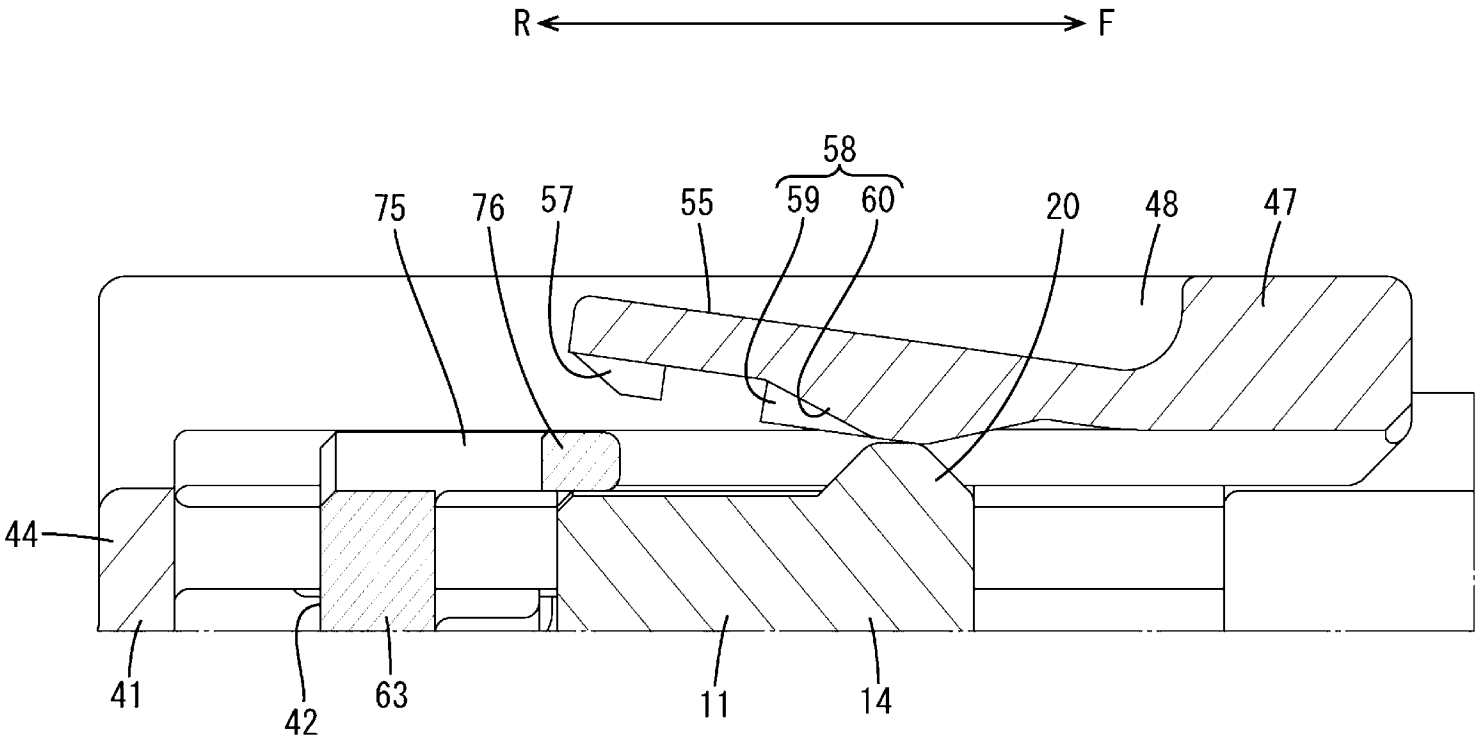
FIG. 5 is a partial enlarged side view in section showing a state where a lock arm is resiliently deformed by a releasing portion and a locking projection is separated from a lock portion in the process of separating the female housing and the male housing.
Figure 6:
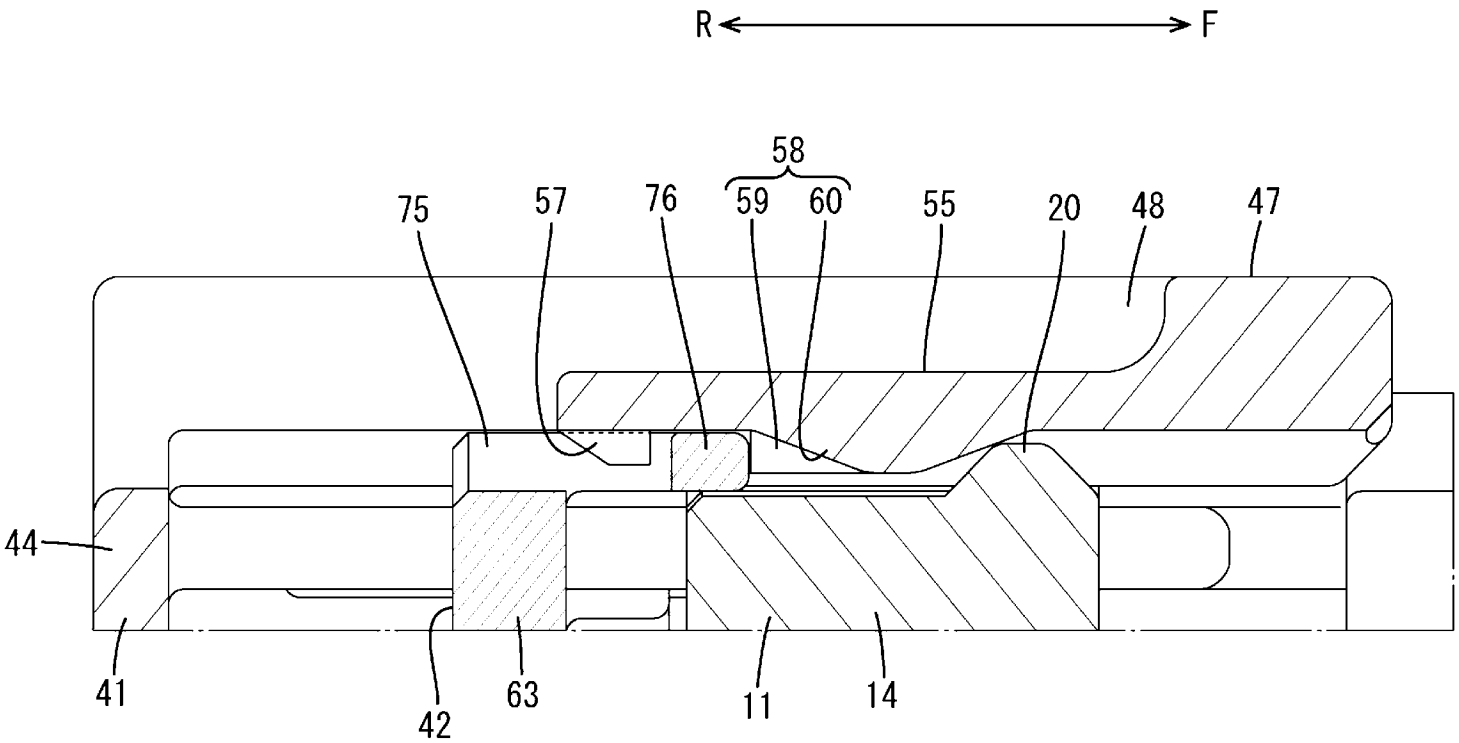
FIG. 6 is a partial enlarged side view in section showing a state where the front surface of the lock portion butts against a stopping projection to a restrict a forward movement of the moving plate in the process of separating the female housing and the male housing.

As shown in FIGS. 5 and 6, the front surface of the releasing portion 20 is inclined rearward, and the rear surface of the releasing portion 20 is inclined forward. As shown in FIG. 4, the rear surface of the hooking portion 21 is inclined forward, and the front surface of the hooking portion 21 is arranged along the lateral direction.

<Lever>

The lever 12 is made of synthetic resin, gate-shaped as a whole and includes a pair of arm portions 22 (see FIGS. 1 and 3) facing each other and a coupling portion 23 (see FIGS. 1 and 2) coupling end parts of the respective arm portions 22. As shown in FIG. 2, the coupling portion 23 includes a projecting piece 29 projecting forward, and a lever-side lock portion 28 inside the projecting piece 29. Although not shown in detail, the lever-side lock portion 28 is resiliently deformable.

As shown in FIGS. 1 and 2, the arm portion 22 is plate-like and includes a shaft hole 24, into which the support shaft 17 is fit, and a cam groove 25 extending from the vicinity of the shaft hole 24 and open in the outer peripheral edge of the arm portion 22. The lever 12 is rotatable between the lever initial position (see FIG. 1) and the lever connection position (see FIG. 2) with respect to the female housing 11 with the support shafts 17 fit in the shaft holes 24.

The lever 12 includes a plurality of lever-side engaging portions 26A, 26B on the arm portions 22. The lever-side engaging portion 26A arranged on a left side of FIGS. 1 and 2 is in the form of a plate projecting forward from the outer peripheral edge of the arm portion 22. The lever-side engaging portion 26B arranged on a right side of FIGS. 1 and 2 is in the form of a stepped recess provided in the outer peripheral edge of the arm portion 22. As shown in FIG. 1, the lever-side engaging portions 26A, 26B are locked to the housing-side engaging portions 18A, 18B, whereby the lever 12 is held at the lever initial position with rotation restricted. Further, as shown in FIG. 2, the lever-side engaging portions 26A are in contact with the housing-side engaging portions 18C when the lever 12 is at the lever connection position.

<Female Terminals>

The female terminal 13 is made of metal and includes, as shown in FIG. 3, a box-shaped female terminal body 27. The front retainer 16 is locked to the rear end edge of the female terminal body 27. The female terminal 13 is retained in the female cavity 15 by being locked by the front retainer 16. Further, a rear end part of the female terminal 13 is crimped and connected to an end part of a wire W1.

<Male Housing>

Figure 8:
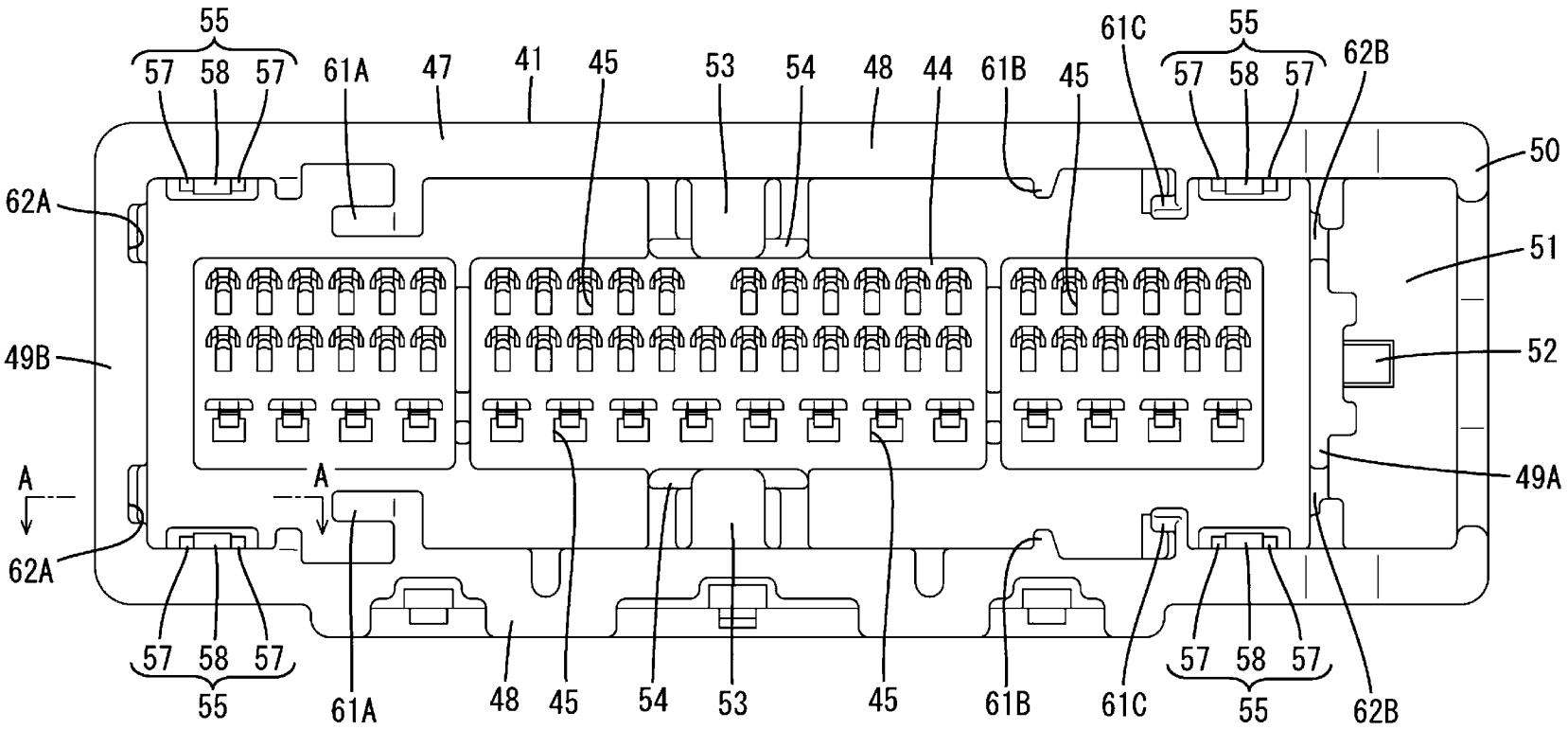
FIG. 8 is a front view of the male housing.

The male housing 41 is made of synthetic resin and includes, as shown in FIG. 8, a male housing body 44 long in the lateral direction. The male housing body 44 includes a plurality of male cavities 45 extending in the front-rear direction. As shown in FIG. 3, the male terminals 43 are inserted and accommodated into the male cavities 45 from behind. A male retainer 46 for retaining the male terminals 43 is mounted into the male housing body 44.

The male housing 41 includes a receptacle 47 projecting forward from the male housing body 44. The receptacle 47 is in the form of a rectangular tube and formed to be one size larger than the male housing body 44. As shown in FIG. 8, the receptacle 47 includes upper and lower walls 48 vertically facing each other and side walls 49A, 49B laterally facing each other.

A lever lock mounting portion 50 laterally outward of the right side wall 49A of FIG. 8 is attached to the male housing 41. An inner space 51 into which the projecting piece 29 is inserted is provided between the lever lock mounting portion 50 and the side wall 49A. The side wall 49A is provided with a housing-side lock portion 52 projecting into the inner space 51. As shown in FIG. 2, the housing-side lock portion 52 is locked to the lever-side lock portion 28, whereby the lever 12 is held at the lever connection position with respect to the male housing 41.

The male housing 41 includes a pair of cam followers 53 projecting from laterally central sides of the inner surfaces of the upper and lower walls 48. When the female housing 11 is lightly fit into the receptacle 47, the cam followers 53 enter the cam grooves 25 of the arm portions 22 (see FIG. 1). By the rotation of the lever 12 between the lever initial position and the lever connection position, the cam followers 53 are engaged with the cam grooves 25 of the arm portions 22 and the female housing 11 and the male housing 41 are connected/separated.

As shown in FIG. 3, the male housing 41 includes a pair of linking portions 54 extending in the front-rear direction between tip parts in a projecting direction of the respective cam followers 53 and the front surface of the male housing body 44. As shown in FIGS. 1 and 8, the linking portions 54 are in the form of plates extending along the front-rear direction and lateral direction.

Figure 9:
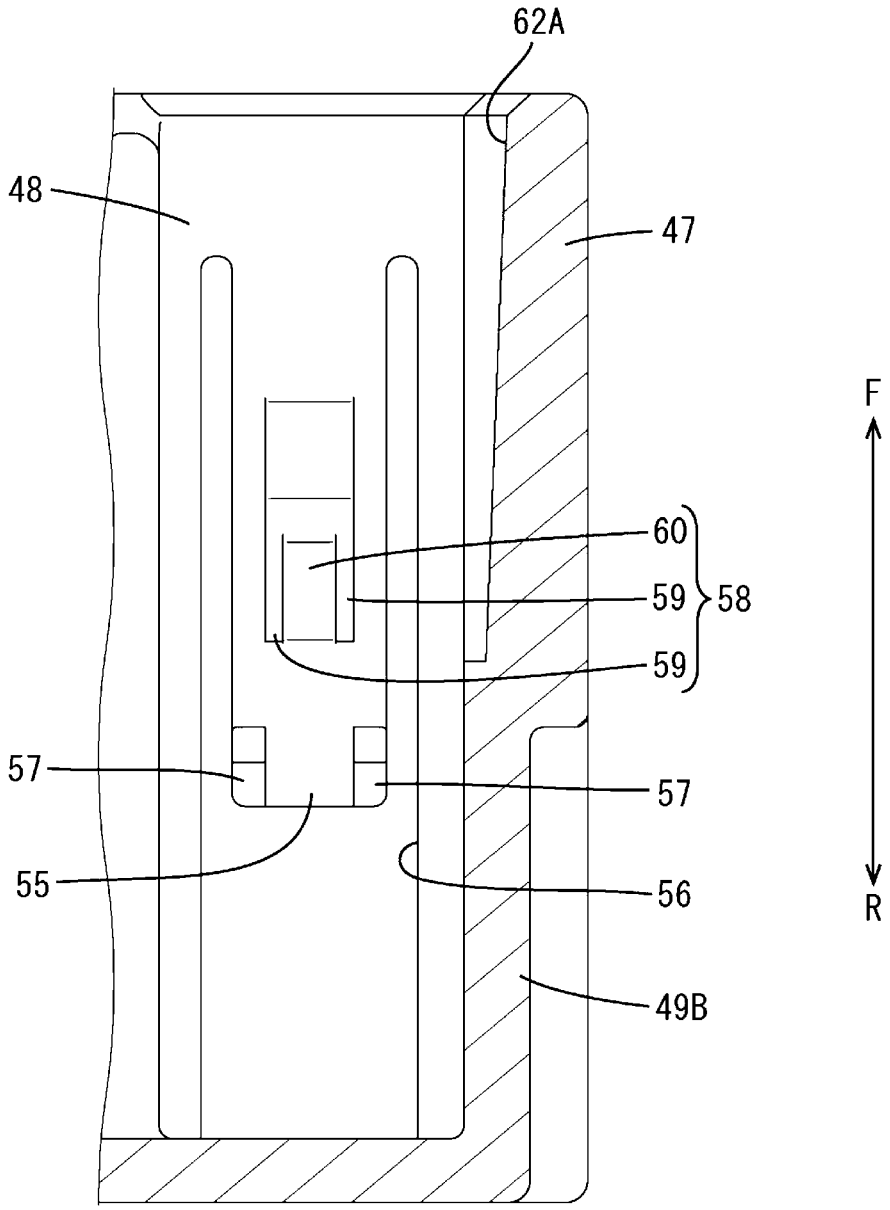
FIG. 9 is a section along A-A of FIG. 8.

As shown in FIG. 8, the receptacle 47 includes a pair of lock arms 55 on both left and right end parts of each of the upper and lower walls 48. As shown in FIG. 9, the lock arm 55 is made resiliently deformably by a cut 56 formed in the upper/lower wall 48 and cantilevered rearward from a front end part of the upper/lower wall 48.

The lock arm 55 includes a pair of locking projections 57 projecting into the receptacle 47 from both left and right end parts of a rear end part (tip part). As shown in FIGS. 5 and 6, the rear surface of the locking projection 57 is inclined forward and the front surface thereof is arranged along the vertical direction.

Further, the lock arm 55 includes a protrusion 58 projecting into the receptacle 47 from an intermediate side of the lock arm 55 forward of the locking projections 57. As shown in FIG. 8, the protrusion 58 is arranged between the respective locking projections 57 when viewed from front. As shown in FIG. 9, the protrusion 58 includes a pair of stopping projections 59 on both left and right end parts and a released portion 60 in a laterally central part. That is, the respective stopping projections 59 and the released portion 60 are arranged side by side in the lateral direction (width direction).

The stopping projection 59 is in the form of a plate located on a rear part of the protrusion 58 and extending along the vertical direction and front-rear direction. As shown in FIGS. 5 and 6, the rear surface (rear end) of the stopping projection 59 is arranged along the vertical direction. The stopping projection 59 restricts a forward movement of the moving plate 42 at the initial position.

As shown in FIGS. 5 and 6, the released portion 60 has a trapezoidal cross-section. The front surface of the released portion 60 is inclined inward (inwardly of the receptacle 47) toward a rear side. The rear surface of the released portion 60 is inclined inward toward a front side. Both left and right ends of a rear part of the released portion 60 are integrally coupled to the respective stopping projections 59. The rear surface of the released portion 60 and the inner surfaces of the stopping projections 59 are orthogonal to each other. A lateral width of the released portion 60 is larger than that of the releasing portion 20. By the contact of the releasing portion 20 with the released portion 60, the lock arm 55 is resiliently deformed.

The receptacle 47 incudes a plurality of guide ribs 61A, 61B extending in the front-rear direction on both left and right sides of the upper and lower walls 48. The respective guide ribs 61A, 61B are arranged closer to a laterally central side than the respective lock arms 55 on the upper and lower walls 48. The left guide ribs 61A of FIG. 8 are larger than the right guide ribs 61B of FIG. 8 and in the form of rails having an L-shaped cross-section. The respective guide ribs 61A, 61B guide a movement of the moving plate 42. Further, the receptacle 47 also includes guide ribs 61C between the guide ribs 61B on the upper and lower walls 48 and the lever lock mounting portion 50.

As shown in FIG. 8, the receptacle 47 includes a pair of escaping grooves 62A, 62B on both upper and lower sides of each of the side walls 49A, 49B. The respective escaping grooves 62A extend in the front-rear direction and are open in the front end of the side wall 49B on both upper and lower sides of the inner surface of the left side wall 49B of FIG. 8. As shown in FIGS. 4 and 9, a side surface of the escaping groove 62A is inclined to widen the escaping groove 62A toward a front side. The respective escaping grooves 62B communicate with the inner space 51 of the lever lock mounting portion 50 and the inside of the receptacle 47 on both upper and lower sides of the inner surface of the right side wall 49A of FIG. 8. Later-described locking portions 73 of the moving plate 42 enter the respective escaping grooves 62A, 62B during resilient deformation.

<Moving Plate>

Figure 10:
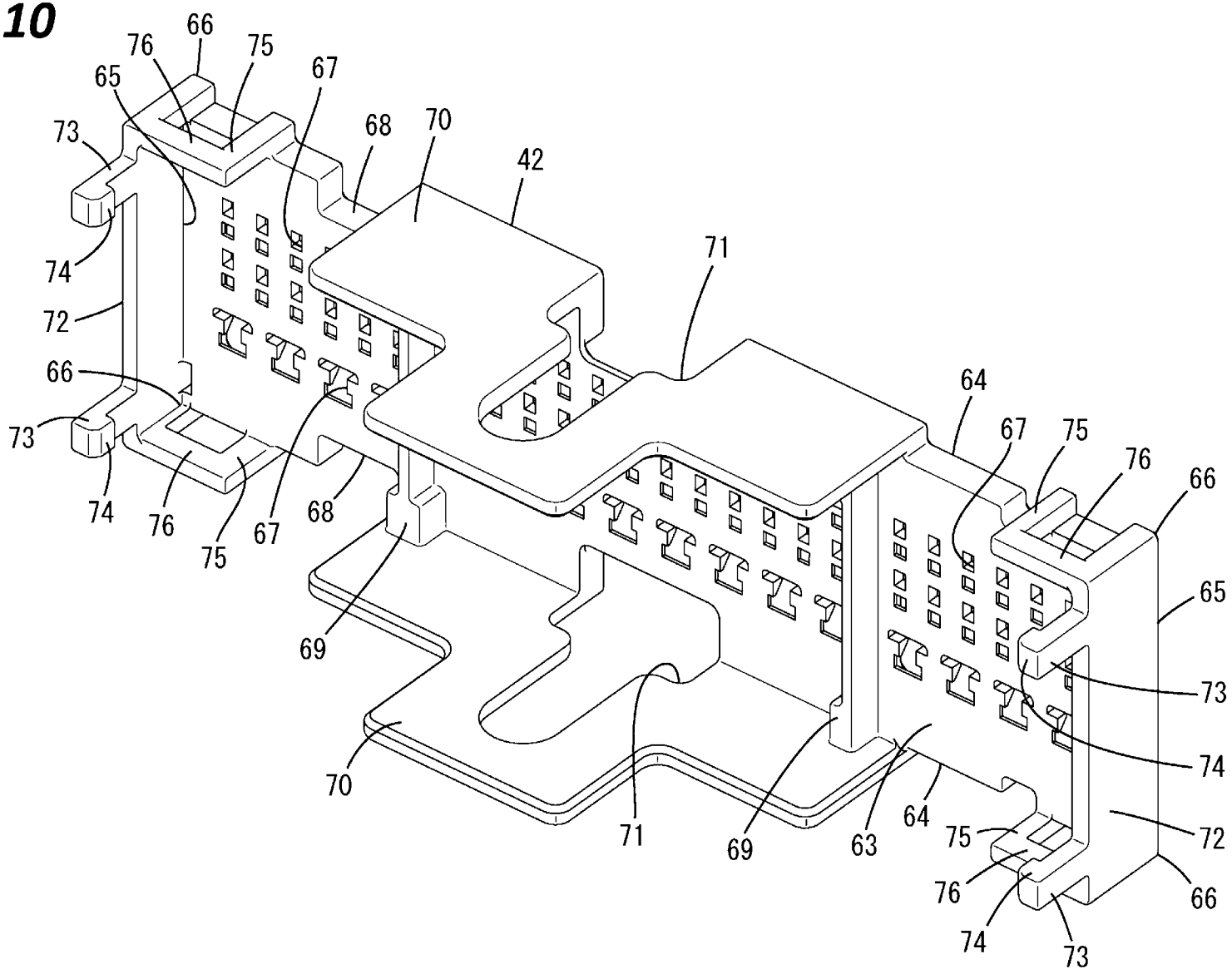
FIG. 10 is a perspective view of the moving plate.

The moving plate 42 is made of synthetic resin and includes, as shown in FIG. 10, a plate body 63 in the form of a rectangular plate. The outer edge of the plate body 63 is composed of a pair of long side portions 64 arranged on upper and lower sides, a pair of short side portions 65 arranged on left and right sides and four corner portions 66 connecting the respective long side portions 64 and the respective short side portions 65 at a right angle. A lateral dimension of the long side portions 64 is larger than a vertical dimension of the short side portions 65.

The moving plate 42 is inserted into the receptacle 47 and movable in the front-rear direction between an initial position (see FIGS. 1 and 3) and a connection position (see FIG. 2) with respect to the male housing 41. The plate body 63 is arranged to cover the inside of the receptacle 47.

The plate body 63 includes a plurality of positioning holes 67. As shown in FIG. 3, the positioning holes 67 are arranged at positions corresponding to the male cavities 45. Front end parts of later-described tabs 79 of the male terminals 43 are positioned and inserted into the positioning holes 67 of the plate body 63.

A recess 68 is provided in each long side portion 64 of the plate body 63. The guide rib 61A is fit into the recess 68. A pair of reinforcing ribs 69 extending in the vertical direction are provided on both left and right sides of the front surface of the plate body 63.

The moving plate 42 includes a pair of guide walls 70 projecting forward from intermediate parts, in particular, laterally central parts, of the respective long side portions 64 of the plate body 63. The guide wall 70 is in the form of a plate extending along the lateral direction and front-rear direction. The upper and lower ends of the respective reinforcing ribs 69 are coupled to the inner surfaces of the respective guide walls 70.

The outer surfaces of the guide walls 70 contact the upper and lower walls 48 of the receptacle 47. Further, both left and right end edges of the guide walls 70 contact the respective guide ribs 61A, 61B. An escaping hole 71 is provided in a laterally central part of the guide wall 70. The escaping hole 71 is open from the guide wall 70 to the plate body 63. As shown in FIG. 1, the cam follower 53 is arranged in the escaping hole 71 to avoid interference with the moving plate 42.

As shown in FIG. 10, the moving plate 42 includes a pair of projecting walls 72 projecting forward from the respective short side portions 65. The projecting wall 72 is in the form of a plate extending along the vertical direction and front-rear direction and formed over the entire height of the plate body 63. The outer surfaces of the projecting walls 72 contact the side walls 49A, 49B of the receptacle 47.

The front end of each projecting wall 72 is arranged along the vertical direction. The moving plate 42 includes a pair of locking portions 73 projecting forward from both upper and lower end parts of the front end of each projecting wall 72. The locking portion 73 includes a hooked portion 74 projecting inward from the front end of a rectangular column-like body part. The locking portion 73 is resiliently deformable with a front end side of the projecting wall 72 as a fulcrum. In the process of moving the moving plate 42 from the connection position to the initial position, the hooked portions 74 of the locking portions 73 are hooked to the hooking portions 21 as shown in FIG. 4.

As shown in FIG. 10, the moving plate 42 includes a plurality of lock coupling portions 75 projecting forward from both left and right end parts of the respective long side portions 64. Further, the moving plate 42 includes lock portions 76 extending in the lateral direction between the front ends of the lock coupling portions 75 and the front ends of the projecting walls 72 (also upper and lower ends of the projecting walls 72).

The lock coupling portion 75, the lock portion 76 and the projecting wall 72 constitute a frame 77 (see FIG. 1) rectangular when the moving plate 42 is viewed from above or below. A lateral dimension of the lock portion 76 is larger than that of the lock arm 55. The lock portion 76 has a rectangular cross-section and has front and rear surfaces extending along the lateral direction. As shown in FIGS. 5 and 6, the front surface of the lock portion 76 is arranged along the vertical direction except both upper and lower end parts. Both upper and lower end parts of the front surface of the lock portion 76 are chamfered into curved surfaces. The rear surface of the lock portion 76 is entirely arranged along the vertical direction. When the moving plate 42 is at the initial position, the lock portion 76 is locked to the locking projection 57 of the lock arm 55 (see FIG. 6).

As shown in FIG. 10, a pair of the lock portions 76 are arranged at positions near the corner portions 66 on both left and right end parts of each long side portion 64. A pair of the locking portions 73 are arranged at positions near the corner portions 66 on both upper and lower end parts of each short side portion 65. Note that the moving plate 42 can be molded by a mold configured to move in the front-rear direction, and a slide mold configured to move in a direction intersecting the front-rear direction is not required in molding.

<Male Terminals>

The male terminal 43 is made of metal and formed into a shape elongated in the front-rear direction as a whole as shown in FIG. 3. The male terminal 43 includes a male terminal body 78 and the tab 79 projecting forward from the male terminal body 78. The male retainer 46 is locked to the rear end edge of the male terminal body 78. The male terminal 43 is retained in the male cavity 45 by being locked by the male retainer 46. Further, a rear end part of the male terminal 43 is crimped and connected to an end part of a wire W2.

<Connecting/Separating Operation of Female Housing and Male Housing>

Prior to the connection of the female housing 11 and the male housing 41, the moving plate 42 is inserted into the receptacle 47 and held at the initial position with respect to the male housing 41. In an assembling process of the moving plate 42, the lock portions 76 slide on the front surfaces of the released portions 60 to resiliently deform the lock arms 55. When the moving plate 42 reaches the initial position, the lock arms 55 resiliently return and the lock portions 76 are arranged between the protrusions 58 (released portions 60 and stopping projections 59) and the locking projections 57 (see FIG. 6). Here, the front surfaces of the lock portions 76 contact the rear surfaces of the respective stopping projections 59 along the vertical direction, whereby a forward movement of the moving plate 42 from the initial position is restricted. Further, the rear surfaces of the lock portions 76 contact the front surfaces of the respective locking projections 57 along the vertical direction, whereby a movement of the moving plate 42 from the initial position to the connection position is restricted. When the moving plate 42 is at the initial position, the locking portions 73 are arranged at positions corresponding to the escaping grooves 62A, 62B (see FIG. 1). The guide walls 70 are arranged along the guide ribs 61A, 61B and the cam followers 53 and the linking portions 54 are arranged to enter the escaping holes 71.

Subsequently, the male terminal 43 is inserted into the male cavity 45 of the male housing 41. Then, the tab 79 of the male terminal 43 projects into the receptacle 47 and the front end part of the tab 79 is arranged through the positioning hole 67 of the moving plate 42 (see FIG. 3). In this way, the tab 79 of the male terminal 43 is protected from external matters.

Subsequently, the female housing 11 having the female terminals 13 set therein is lightly fit into the receptacle 47. In the process of fitting the female housing 11 into the receptacle 47, the hooking portions 21 contact the hooked portions 74 and the locking portions 73 are resiliently deformed to enter the escaping grooves 62A, 62B. If the female housing 11 is further fit, the locking portions 73 resiliently return and the hooking portions 21 are arranged between the front surface of the male housing body 44 and the hooked portions 74. The cam followers 53 are arranged to enter the entrances of the cam grooves 25 of the lever 12 at the lever initial position. Further, a locked state of the lever-side engaging portions 26A and the housing-side engaging portions 18A is released by the guide ribs 61C, and the lever 12 becomes rotatable to the lever connection position. Then, the rear surfaces of the releasing portions 20 slide on the front surfaces of the released portions 60 to resiliently deform the lock arms 55. In this way, the locking projections 57 are displaced away from the lock portions 76 and a locked state of the locking projections 57 and the lock portions 76 is released, with the result that the moving plate 42 also becomes movable to the connection position.

Subsequently, the lever 12 is rotated from the lever initial position toward the lever connection position. In the process of rotating the lever 12, the cam followers 53 slide on groove surfaces of the cam grooves 25 and the connection of the female housing 11 and the male housing 41 progresses. When the female housing 11 moves to a back side of the receptacle 47, the rear surface of the female housing body 14 presses the plate body 63 and the moving plate 42 also moves to the back side of the receptacle 47.

When the lever 12 reaches the lever connection position, the lever-side lock portion 28 locks the housing-side lock portion 52 to stop the rotation of the lever 12 (see FIG. 2). At this time, the cam followers 53 are located on back end sides of the cam grooves 25 and the female housing 11 and the male housing 41 are properly connected. When the female housing 11 and the male housing 41 are properly connected, the female terminals 13 and the male terminals 43 are also properly electrically connected. When the female housing 11 and the male housing 41 are properly connected, the moving plate 42 also reaches the connection position and the plate body 63 contacts the male housing body 44.

The female housing 11 and the male housing 41 may be separated for a certain reason such as maintenance. In this case, the locked state of the lever-side lock portion 28 and the housing-side lock portion 52 is first manually released and the lever 12 is rotated from the lever connection position to the lever initial position. Then, the cam followers 53 slide on the groove surfaces (groove surfaces opposite to those during connection) of the cam grooves 25 and the separation of the female housing 11 and the male housing 41 progresses.

In the process of moving the female housing 11 away from the back side of the receptacle 47, the releasing portions 20 of the female housing 11 slide in contact with the rear surfaces of the released portions 60 to resiliently deform the lock arms 55 as shown in FIG. 5. Further, in the process of moving the female housing 11 away from the back side of the receptacle 47, the hooking portions 21 contact the hooked portions 74 as shown in FIG. 4 and the moving plate 42 moves in a direction away from the back side of the receptacle 47 together with the female housing 11. In other words, the moving plate 42 moves toward the initial position. Note that when the hooking portions 21 contact the hooked portions 74 and the moving plate 42 starts to move toward the initial position, the locking portions 73 contact the side walls 49A, 49B of the receptacle 47, thereby being kept without being resiliently deformed.

In the process of moving the moving plate 42 toward the initial position, the lock portions 76 reach positions corresponding to the locking projections 57. As described above, the lock arms 55 are resiliently deformed and the locking projections 57 are retracted in a direction away from the lock portions 76 (see FIG. 5). Thus, even if the lock portions 76 interfere with the locking projections 57, interference resistance can be suppressed to be small or interference with the locking projections 57 itself can be avoided.

When the female housing 11 is further separated, the releasing portions 20 ride over the released portions 60 and the lock arms 55 resiliently return. As the lock arms 55 resiliently return, the lock portions 76 are arranged between the locking projections 57 and the protrusions 58 and the moving plate 42 returns to the initial position.

Even if the moving plate 42 returns to the initial position, the female housing 11 continues to move forward by the rotation of the lever 12. In contrast, the moving plate 42 is restricted from moving forward beyond the initial position and, consequently, the escape thereof from the receptacle 47 is restricted by the front surfaces of the lock portions 76 butting against the rear surfaces of the respective stopping projections 59 as shown in FIG. 6. When the front surfaces of the lock portions 76 butt against the rear surfaces of the respective stopping projections 59, the locking portions 74 are arranged at positions corresponding to the escaping grooves 62A, 62B (see FIG. 4). Thus, the locking portions 74 can be resiliently deformed and enter the escaping grooves 62A, 62B. If the locking portions 73 are resiliently deformed, the locked state of the hooking portions 21 and the hooked portions 74 is released and the hooking portions 21 are separated forward from the hooked portions 74. In this way, the female housing 11 is separated from the receptacle 47 with the moving plate 42 left at the initial position.

When the moving plate 42 moves between the initial position and the connection position, the guide walls 70 slide on the inner surfaces of the upper and lower walls 48 of the receptacle 47 while being guided by the guide ribs 61A, 61B (see FIGS. 1 and 2), and the projecting walls 72 slide on the inner surfaces of the side walls 49A, 49B of the receptacle 47. Thus, the moving plate 42 can smoothly move without being inclined in the receptacle 47.

As described above, according to this embodiment, when the moving plate 42 is at the initial position, the front surfaces of the lock portions 76 face the stopping projections 59, thereby restricting a forward movement of the moving plate 42, and the rear surfaces of the lock portions 76 face the locking projections 57, thereby restricting a movement of the moving plate 42 to the connection position. Thus, structures for restricting a movement of the moving plate 42 at the initial position are consolidated on the lock portions 76 and the configuration of the moving plate 42 can be simplified.

Particularly, since the front surfaces of the lock portions 76 are arranged along the vertical direction, a forward movement of the moving plate 42 at the initial position is satisfactorily restricted. If the front surfaces of the lock portions 76 extending along the vertical direction interfere with the locking projections 57 in the process of moving the moving plate 42 from the connection position to the initial position, interference resistance becomes excessive and the moving plate 42 cannot smoothly move. However, according to this embodiment, since the releasing portions 20 of the female housing 11 contact the rear surfaces of the released portions 60 to resiliently deform the lock arms 55 in the direction away from the lock portions 76, the interference of the lock portions 76 and the locking projections 57 is avoided or mitigated. Thus, the moving plate 42 can smoothly move.

Further, since the locking portions 73 and the lock portions 76 are respectively arranged on the sides of the four corner portions 66 of the short side portions 65 and the long side portions 64 in the case of this embodiment, formation regions of the guide walls 70 can be satisfactorily secured in intermediate parts (laterally central sides) of the long side portions 64.

Other Embodiments of Present Disclosure

The embodiment disclosed this time should be considered illustrative in all aspects, rather than restrictive.

Although the hooking portions are provided in the female housing in the case of the above embodiment, hooking portions may be provided on the lever according to another embodiment. For example, the groove surfaces of the cam grooves of the lever may serve as the hooking portions, the moving plate may be provided with plate-side cam followers configured to enter the cam grooves, and these plate-side cam followers may serve as hooked portions. In this case, the plate-side cam followers slide on the groove surfaces of the cam grooves and the moving plate becomes movable between the initial position and the connection position by the rotation of the lever.

Although one pair of the locking portions are arranged on both upper and lower end parts of each short side portion and one pair of the lock portions are arranged on both left and right end parts of each long side portion in the case of the above embodiment, one pair of locking portions may be arranged on both left and right end parts of each long side portion and one pair of lock portions may be arranged on both upper and lower end parts of each short side portion according to another embodiment.

Although the front surfaces of the lock portions and the rear surfaces of the stopping projections are arranged along the vertical direction in the case of the above embodiment, at least either the front surfaces of the lock portions or the rear surfaces of the stopping projections may be arranged obliquely with respect to the vertical direction according to another embodiment.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a male housing including a receptacle open forward;

a female housing to be fit into the receptacle;

a moving plate to be arranged in the receptacle movably between an initial position and a connection position rearward of the initial position; and a male terminal arranged to project into the receptacle, a front end part of the male terminal being covered by the moving plate at the initial position;

wherein:

the receptacle includes a resiliently deformable lock arm extending in a front-rear direction, the female housing includes a releasing portion at a position corresponding to the lock arm, the lock arm includes a locking projection projecting into the receptacle from a rear end part of the lock arm, a released portion projecting into the receptacle from a location forward of the locking projection, and a stopping projection projecting into the receptacle from the location forward of the locking projection, the moving plate includes a lock portion at a position corresponding to the lock arm, a rear surface of the lock portion faces the locking projection to restrict a movement of the moving plate to the connection position and a front surface of the lock portion faces the stopping projection to restrict a forward movement of the moving plate when the moving plate is at the initial position, and a rear surface of the released portion is shaped to be inclined forward and contacts the releasing portion to displace the lock arm in a direction away from the lock portion when the moving plate moves from the connection position to the initial position.

2. The connector of claim 1, wherein:

the female housing includes a hooking portion and the moving plate includes a locking portion to be locked to the hooking portion to enable a movement from the connection position to the initial position, the moving plate includes a plate body having a rectangular outer edge shape formed by a pair of short side portions, a pair of long side portions and four corner portions, either the locking portions or the lock portions are arranged in a pair on the sides of the corner portions on each of the pair of long side portions and the others of the lock portions and the locking portions are arranged in a pair on the sides of the corner portions on each of the pair of short side portions, and the hooking portions are arranged at positions corresponding to the respective locking portions and the lock arms are arranged at positions corresponding to the respective lock portions.

3. The connector of claim 2, wherein:

the moving plate includes guide walls projecting forward from intermediate parts of the pair of long side portion, and the receptacle includes guide ribs on inner surfaces facing the pair of long side portions, the guide ribs extending in the front-rear direction and contacting the guide walls.

* * * * *